United States Patent [19]

Barrie

[11] Patent Number: 5,024,448

[45] Date of Patent: Jun. 18, 1991

[54] FLEXIBLE VANE FOR ARROWS

[76] Inventor: Robert L. Barrie, #2 Knoll Dr., Waseca, Minn. 56093

[21] Appl. No.: 410,300

[22] Filed: Sep. 21, 1989

[51] Int. Cl.[5] ..... F42B 6/06

[52] U.S. Cl. ..... 273/423

[58] Field of Search ..... 273/423, 420

[56] References Cited

U.S. PATENT DOCUMENTS

| | | | |
|---|---|---|---|
| 2,830,818 | 4/1958 | Otto | 273/423 |
| 3,749,403 | 7/1973 | Austin et al. | 273/423 |
| 4,488,728 | 12/1984 | Humphrey | 273/423 |

*Primary Examiner*—Paul E. Shapiro

*Attorney, Agent, or Firm*—James R. Cwayna

[57] ABSTRACT

An arrow vane arranged and constructed for attachment to an archery arrow consisting of a plurality of joined pleated on convoluted sections extending from a forwardly directed end and extending radially outward from the arrow body to a rear portion adjacent the nock of the arrow. The convoluted or pleated sections are so formulated as to be compressible in direct radial fashion, one such pleat resting directly upon the other without sideways distortion or curvalinear offset when the vane is compressed as by passing against the side of the bow when the arrow is shot from the bow. Such aligned compression is maintained due to the particle shape and sizing of the individual convolute or pleat connective sections.

9 Claims, 1 Drawing Sheet

FLEXIBLE VANE FOR ARROWS

FIELD OF THE INVENTION

This invention relates generally to vanes for archery arrows and more particularly to a collapsible vane which will collapse in a radial linear or straight line fashion.

SHORT SUMMARY OF THE INVENTION

A plastic vane to act as an archery feather which includes a vane attachable to the arrow near the nock end thereof having an arcuate mounting base for attachment to the arrow and a plurality of convolutes extending from a forward pointed end and directed rearwardly and radially outwardly from the arrow body. The vane provides directional stability to the arrow during its flight. The convolutes extending radially outward from the arrow body are particularly sized and shaped to provide what may be termed inline collapsing which collapse is due to the arrow passing the bow as it is shot. The radial inline collapsing insures that the vane, upon decompression or passing an obstruction will be directed linearly radially outward rather than in a possible curvilinear arrangement to the arrow. Such curvilinear arrangement upon decompression would cause the arrow to stray from its aimed direction. The inline compression situation is provided from the particular shape of the individual convolutes or pleats and the particular manner of joinder of the convolutes.

BACKGROUND AND OBJECTS OF THE INVENTION

As is well known in the archery field, the original vanes fletchings for arrows were formed from feathers. The industry has now substantially gone to plastic or other non-natural material vanes. When using feathers the vanes would collapse as they passed by the bow upon being shot and resume a radial position after passing the same. With plastic elements it is necessary to provide for some sort of collapsing of the vane as it contacts the bow with proper radial return after passing the same or the arrow will be mistracked from its aimed direction.

In his search of the prior art the applicant has only found two particular patents that appear to be directed to collapsible vane structures. These include the U.S. Pat. No. 3,749,403 to Austin and a Design U.S. Pat. No. D243,527 to Schnipke.

The Austin patent includes a plurality of individual barbs of soft, flexible plastic of a two sided angularly arranged cross section to nest into one another upon the application of a radial compression force such as would be obtained in passing the bow structure.

The patent to Schnipke is a Design patent wherein the vane of the arrow appears to be preformed into an arcuate bow such that upon passing a solid structure it will be further compressed obliquely to the arrow body.

Therefore, the Austin patent appears to be the only applicable art which is directed to possible radial inline collapsing of the vane.

It is therefore an object of the applicant's invention to provide a plastic vane for an archery arrow which will compress in direct radial linear fashion as the arrow is shot past the bow and the vane comes in contact with the bow.

It is still a further object of the applicant's invention to provide a vane for an archery arrow which includes a curvilinear mounting surface for attachment of the same to the arrow with a plurality of convoluted or pleated sections extending radially outward and rearwardly from a forwardmost end and wherein the size and shape of the individual convolutes is determined to provide what may be termed a radial inline compression of the vane member. These vanes could also be parallel of the shaft.

It is still a further object of the applicant's invention to provide a vane for an archery arrow which includes a plurality of convoluted or pleated sections arranged to extend radially outwardly and rearwardly from a forwardmost end of the vane, which pleated members are joined with a particular joinder configuration to insure bending and compression thereof against one another in direct radial direction and to, after compression force is released, extend radially outwardly from the arrow.

These and other objects and advantages of the applicant's invention will more thoroughly appear from the accompanying description made in association with the accompanying drawings.

SHORT DESCRIPTION OF THE DRAWINGS

Figure 4:
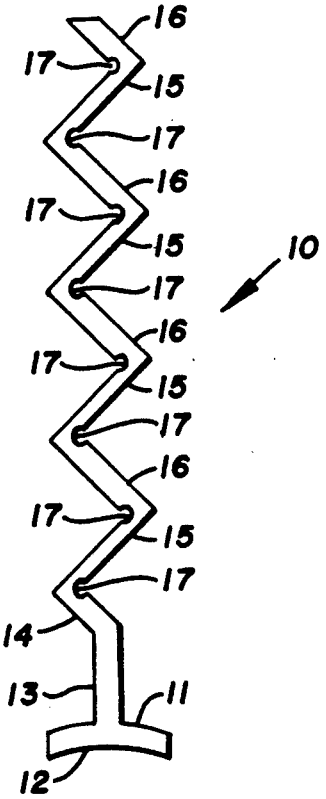
Figure 5:
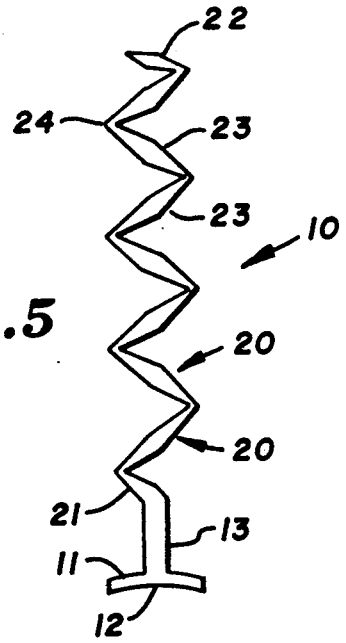

FIG. 4 is an enlarged view taken from the rear of a first form of the invention illustrating a particular arrangement for joinder of the convolute or pleated sections wherein the joint is substantially a right angle and a second form of the invention is illustrated on this same Figure in which the internal joinder point is provided with an arcuate break or fold section; and, FIG. 5 is yet another modified form of the invention illustrating a particular design for the individual convolutes of the vane.

DESCRIPTION OF THE VARIOUS FORMS OF THE INVENTION

Figure 1:
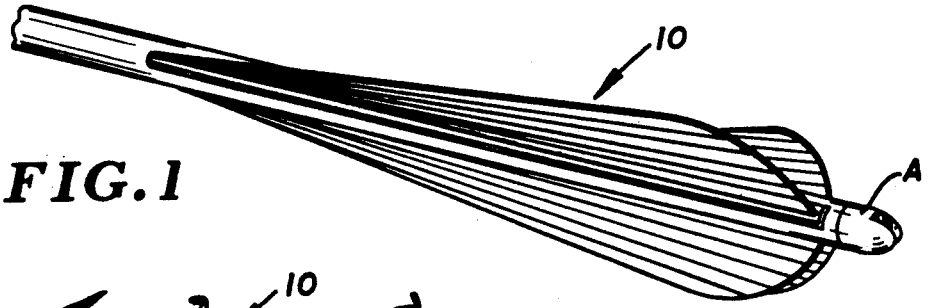
FIG. 1 is a perspective view of a portion of an arrow illustrating vanes embodying the applicant's invention mounted thereon.
Figure 2:
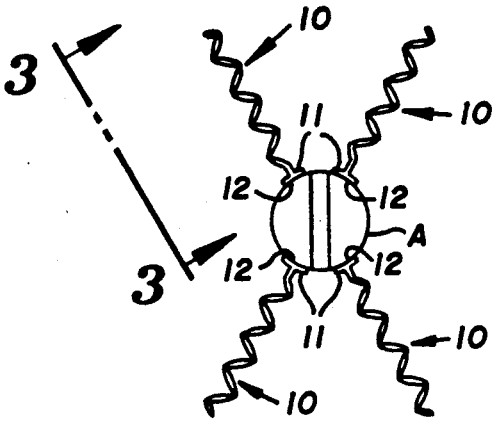
FIG. 2 is a rear view of the arrow illustrated in FIG. 1 wherein four such vanes are positioned about the circumference of the arrow.

As illustrated in the accompanying drawings the vane embodying the concepts of the applicant's invention is generally designated 10 and specific designations will be utilized for the various forms of the invention as this description proceeds. As illustrated, the vanes are mounted about the circumference of an arrow A at specific locations. As illustrated in FIG. 2, four such vanes are illustrated and it is well known that very often three vanes will be utilized and, in the condition of four vanes they may be set at 90° positions rather than the angularity offset that is illustrated in FIG. 2. As is well known in the art, these vanes are located near the rear end or nock end of the arrow and the purpose of such vanes is well known, as to maintain the flight stability of the arrow after being shot.

Vanes 10 are of a predetermined length, normally selected in accordance with the length of the arrow and a mounting member 11 extends the entire length of the vane 10. This mounting member 11 as illustrated provides a base unit for attachment of the vane 10 to the arrow and as illustrated, particularly in FIGS. 2, 4 and 5 the innermost surface 12 of this mounting member 11 is provided with a radius corresponding to the arrow A diameter for proper attachment of the same to the circular body of the arrow A. Attachment of the vanes 10 through this mounting member 11 may be obviously made through adhesive materials.

A first and a modified form of the invention is combined in FIG. 4.

Figure 3:
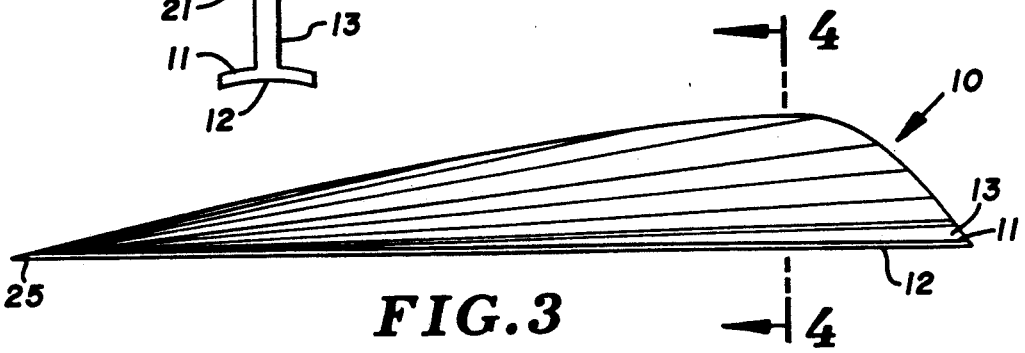
FIG. 3 is a side elevation of the applicant's vane taken substantially along Line 3—3 of FIG. 2.

In a first form of the invention an upstanding leg 13 is arranged to be positioned on the upper surface of mounting member 11 and this leg 13 will extend radially outwardly from the arrow mounting member 11 to a first, what may be termed half pleat 14. As illustrated in FIG. 3 this mounting leg 13 exists only at the rearmost end of the vane as the same tapers radially outwardly as do the pleated sections from the forward end of the vane 10 to the rearward end thereof. This half pleat 14 is arranged at a 45° angle to the upstanding leg 13. From there on the pleated sections alternate in thicknesses but are arranged at 90° angles with respect to each other. The first succeeding pleated section 15 extending at 90° from half leg 14 is of a slightly diminished thickness to half leg 14 and with regard to the next succeeding pleated section 16. As illustrated, the numerals 15 illustrate the pleated sections of diminished thickness as compared to the pleated section 16. As an example, the applicant's dimensions from the diminished pleated sections 15 to the thicker pleated sections 16 is 0.005 inches. Dimensions that the applicant has selected certainly can be considered to be within a range but applicant has found that with a dimension of 0.015 for the thinner or diminished cross sectional section 15 and a dimension of 0.020 for the thicker pleated sections will provide a sufficiently pliable and flexible unit that will fold, when a force is applied to the outermost surface thereof, directly in radial alignment with the upstanding leg section 13. Obviously with this type of pleating or folding, upon release of the compressing pressure, the vane will extend in a radial direction outwardly of the arrow.

As illustrated in the first discussed form of the invention the joinders between the reduced leg pleats and the larger leg pleats is at 90° and is without any disruption in the corner or connective association. In a second form of the invention which is also illustrated on FIG. 4 a first modification is provided. This modification is to provide the innermost joining area with a positive bend area which is produced by providing an arcuate or other reduced corner 17 at the joinder of any two sections. Obviously if this were the selected form of the invention to be utilized it would be used at all such inner corners. Such a material removal will assist in insuring positive bending in the radial direction of the joined legs.

A further modified form of the invention is illustrated in FIG. 5. In this form of the invention the same arcuately formed mounting member 11 having the arcuate attachment surface 12 is provided and the upstanding leg section 13 is similarly provided. Each of the leg sections is designated 20 and each is of the same configuration. As with the form illustrated in FIG. 4 a first half leg 21 is provided and the vane terminates with an additional half leg 22 at the outermost end thereof. Each of the individual legs 20 are of a diamond shape configuration having the cross section at the approximate center point thereof 23 of greatest cross sectional dimension and tapering to the end points of each leg 20 to provide a minimal cross section 24 at the point of joinder between two succeeding legs. Applicant has found that this configuration also provides the desired radial compressive situation and radial extension situation.

Again, the dimensions that applicant has found suitable for the area of larger cross section and reduced cross section include a 0.005 differentiation with the larger or greater cross section being 0.020 and the reduced section being 0.015. It should also be considered that the entire radial dimension of the unit has been tested successfully with the dimension of 0.602 and the dimension between a pair of such legs has been found to be 0.122. The transverse dimension which is established from one bend joint to another bend joint is found to be appropriate and operable at 0.080. These dimensions are representative of the unit as taken at 4.25 inches from the forwardmost end 25 of the vane 10 to the rear end thereof.

It should be obvious that the dimensions recited are those which the applicant has found to be effective and efficient for properly guiding the arrow through the air and to provide proper collapsing of the various sections of the vane. There is no question that these dimensions could be modified without departing from the scope of the concept of the invention which is to provide a radially inline collapsible vane for an arrow.

It should be obvious that the applicant has provided a new and unique collapsible vane for an archery arrow which will insure radial inline collapsing of the vane when placed under compression and therefore will insure inline extension and radial extension of the same upon release of the compressing force. The vane provides a flexible vane to fold out of the way of solid structures and also creates an air flow which stabilizes the arrow flight.

What I claim is:

1. A collapsible vane for attachment to an archery arrow including:

a. a first mounting member of a predetermined length providing a forwardmost and a rearmost end having an arcuately formed lower surface which conforms to the diameter of the arrow to which the vane will be attached;

b. the collapsible vane extending from said forwardmost end of said lower mounting member surface to the rearmost end thereof and increasing in radial dimension from said forwardmost end to a point spaced from said rearmost end;

c. the collapsible vane including a plurality of pleated, convolute section arranged and constructed to compress radially when a compressive force is applied to the outermost of said sections; and, d. each of the convolutes extending from the forwardmost end of said mounting member toward the rearmost end thereof.

2. The collapsible vane as set forth in claim 1 and each of said pleated, convolute sections being arranged at ninety degrees to the next adjacent section and bendably joined thereto.

3. The collapsible vane as set forth in claim 1 and alternate sections thereof being of a first cross sectional dimension and each of such alternate sections being joined to one another by an intermediate section of a reduced cross-sectional dimension.

4. The collapsible vane as set forth in claim 3 and said first dimensional cross section being 0.020 inches and said reduced cross section dimension of said intermediate sections being 0.015 inches.

5. The collapsible vane as set forth in claim 1 and the inner connective corner of joined sections being reduced in cross section to provide a positive bend area between such sections.

6. The collapsible vane as set forth in claim 1 and each of such pleated, convolute sections including a cross section of a diamond shape, the centermost portion of said cross section being of a first dimension and the endmost portions being of a reduced cross section, said reduced cross sectional end portions providing joinder between adjacent sections and providing the bendable joint therebetween.

7. The collapsible vane as set forth in claim 6 and the cross sectional dimension of said centermost portion of said diamond shaped sections being 0.020 inches and the cross sectional dimension of said reduced end portions being 0.015 inches.

8. The collapsible vane as set forth in claim 1 and said vane being formed of a plastic material.

9. The collapsible vane as set forth in claim 1 and an upstanding leg member arranged on and extending from the forwardmost end of said mounting member to the rearmost end there and tapering radially outwardly from the forwardmost end to the rearmost end, said convolutes being arranged on the outermost end thereof from the forwardmost end to the rearmost end.

* * * * *